US005097895A

United States Patent [19]

Assaf

[11] Patent Number: 5,097,895

[45] Date of Patent: Mar. 24, 1992

[54] HEAT EXCHANGER, SYSTEM AND METHOD FOR USING THE SAME

[75] Inventor: Gad Assaf, Rehovot, Israel

[73] Assignee: Geophysical Engineering Company, Seattle, Wash.

[21] Appl. No.: 636,096

[22] Filed: Dec. 31, 1990

Related U.S. Application Data

[60] Division of Ser. No. 356,681, May 25, 1989, Pat. No. 4,981,021, which is a continuation-in-part of Ser. No. 148,709, Jan. 26, 1988, Pat. No. 4,872,315, which is a division of Ser. No. 798,841, Nov. 18, 1985, Pat. No. 4,745,436, which is a division of Ser. No. 558,436, Dec. 6, 1983, Pat. No. 4,583,370.

[51] Int. Cl.[5] ..... F23D 15/00

[52] U.S. Cl. ..... 165/140.14; 165/104.19; 165/46; 165/905

[58] Field of Search ..... 165/104.19, 104.21, 165/140.14, 46, 905

[56] References Cited

U.S. PATENT DOCUMENTS

| | | | |
|---|---|---|---|
| 837,499 | 12/1906 | Perkins et al. . | |
| 2,893,706 | 7/1959 | Smith | 165/104.19 |
| 3,018,231 | 1/1962 | Valentine et al. . | |
| 3,256,703 | 6/1966 | Selwitz | 165/46 |
| 4,094,357 | 6/1978 | Sgroi | 165/46 |
| 4,259,849 | 4/1981 | Griffiths . | |
| 4,279,294 | 7/1981 | Fitzpatrick et al. | 165/46 |
| 4,313,420 | 2/1982 | Poeschl . | |
| 4,355,683 | 10/1982 | Griffiths . | |
| 4,370,860 | 2/1983 | Assaf . | |
| 4,412,426 | 11/1983 | Yuan | 165/45 |
| 4,803,846 | 2/1989 | Assaf . | |

*Primary Examiner*—Albert W. Davis, Jr.
*Attorney, Agent, or Firm*—Sandler, Greenblum, & Bernstein

[57] ABSTRACT

A heat exchanger according to the present invention comprises a housing for containing an upper and a lower layer of fluid, means for preventing intermixing of the two fluids, and heat transfer means for enhancing the transfer of heat between the layers. Specifically, the heat exchanger means is in form of a plurality of elongated cylinders extending into both layers, each of said cylinders containing a convective fluid. Preferably, the convective fluid is a liquid; and the preferred liquid includes water. Where the fluid in each of said upper and lower layers is a gas, the preferred orientation of the cylinders is vertical. The hotter fluid should be beneath the cooler fluid so that heat from the hotter fluid is first transferred to the liquid in the lower ends of each cylinder. The buoyancy of the heated liquid sets up convection currents which carry the heated liquid upwardly in the vertical cylinders where the heat is given up to the cooler fluid. Although a larger heat transfer surface is involved, the material cost of the heat exchanger is relatively low, and a relatively compact heat exchanger results. To further enhance heat transfer, the hotter and cooler fluids should be in counter-flow arrangement.

15 Claims, 2 Drawing Sheets

HEAT EXCHANGER, SYSTEM AND METHOD FOR USING THE SAME

RELATED APPLICATIONS

This is a division of application Ser. No. 07/356,681 filed May 25, 1989 now U.S. Pat. No. 4,981,021 issued Jan. 1, 1991 which is a continuation in part of application Ser. No. 07/148,709 filed Jan. 26, 1988 which is now U.S. Pat. No. 4,872,315; which is a divisional application of U.S. Ser. No. 06/798,841 filed Nov. 18, 1985 which is now U.S. Pat. No. 4,745,436; which is a divisional of U.S. Ser. No. 06/558,436 filed Dec. 6, 1983 which is now U.S. Pat. No. 4,583,370.

DESCRIPTION

1. Technical Field

This invention relates to an improved heat exchanger, and to a system and method for using the same for conditioning air in an enclosure, particularly a greenhouse.

2. Background of the Invention

A system for conditioning air in an enclosure by directly contacting the air therein with a brine shower is disclosed in U.S. Pat. No. 4,803,846 issued Feb. 14, 1989, the disclosure of which is hereby incorporated by reference. In such system, air in an enclosure is contacted with a first air-brine-vapor heat exchanger causing water vapor in the air to condense on the brine droplets thereby drying the air. The dilute brine so produced may be regenerated by contacting it with warmed air segregated from the air in the enclosure using a second air-brine-vapor heat exchanger. As a result, water in the dilute brine is evaporated producing concentrated brine that is made available for the first heat exchanger. In order to return the latent heat of vaporization released to the segregated air during the regeneration process, the segregated air is contacted with one side of a heat transfer medium whose other surface is in contact with the air in the enclosure. By reason of the contact of warm moist segregated air with the heat transfer medium, and the contact of cooler enclosure air with the other surface, vapor in the segregated air condenses on said one surface of the heat transfer medium releasing the latent heat of condensation to the enclosure air.

For practical reasons involving ease of manufacture and low cost, heat transfer medium in the form of thin plastic films have been employed. Specifically, the regeneration process was carried out in ducts constructed of plastic film; and the size of such ducts are quite large. For example, for a greenhouse of about 3000 $m^2$, a duct about 100 m. in length and about $0.5 \times 0.5$ m. cross-section is required because of the relatively inefficient manner in which heat transfer takes place across a thin plastic film when low velocity air flows thereover. A size reduction and an increase in heat transfer efficiency could be realized by a redesigned heat exchanger that would employ a solid material, rather than a plastic film, and a system that would increase the velocity of air in contact with the material. The conventional approach of using a shell and tube heat exchanger would produce a small, highly efficient heat exchanger, but the cost would be prohibitive.

It is therefore an object of the present invention to provide a new and improved heat exchanger, system, and method for using the same which, when used in conditioning units, can efficiently and inexpensively returns to the enclosure latent heat contained in moist air produced by the concentration of dilute brine.

BRIEF DESCRIPTION OF THE INVENTION

A heat exchanger according to the present invention comprises a housing for containing an upper and a lower layer of fluid, means for preventing intermixing of the two fluids, and heat transfer means for enhancing the transfer of heat between the layers. Specifically, the heat exchanger means is in form of a plurality of closed sleeves, such as elongated cylinders that extend into both layers, each of said cylinders containing a convective fluid.

Preferably, the convective fluid is a liquid; and the preferred liquid includes water. Where the fluid in each of said upper and lower layers is a gas, the preferred orientation of the cylinders is vertical. The hotter fluid should be beneath the cooler fluid so that heat from the hotter fluid is first transferred to the liquid in the lower ends of each cylinder. The buoyancy of the heated liquid sets up convection currents which carry the heated liquid upwardly in the vertical cylinders where the heat is given up to the cooler fluid. Although a large heat transfer surface is involved, the material cost of the heat exchanger is relatively low, and a relatively compact heat exchanger results. To further enhance heat transfer, the hotter and cooler fluids should be in counterflow arrangement.

BRIEF DESCRIPTION OF THE DRAWINGS

Embodiments of the invention are shown in the accompanying drawings wherein.

DETAILED DESCRIPTION

Figure 1:
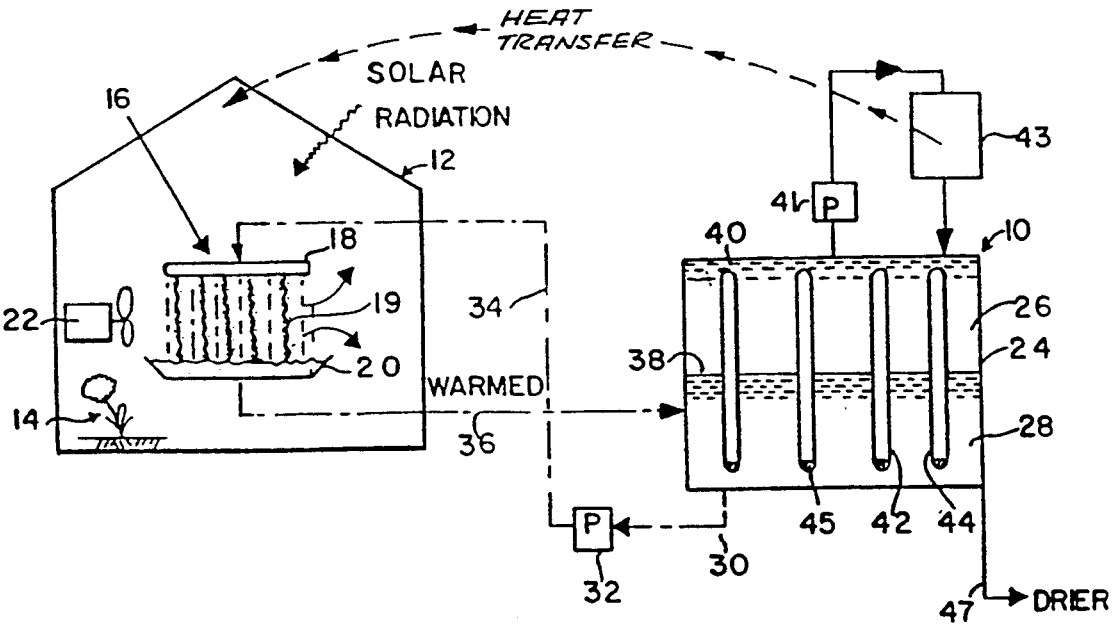
FIG. 1 is a schematic block diagram of a heat exchanger in accordance with the present invention used in combination with an enclosure, the air of which is dried during the day.

Referring now to the drawings, reference numeral 10 designates a heat exchanger according to the present invention used for conditioning the air in enclosure 12 which symbolically represents a greenhouse. Enclosure 12 contains growing plants 14, the expiration of which produces water vapor during daylight hours. Solar radiation, during daylight hours, warms the greenhouse and increases the temperature of the greenhouse. Environmental conditions in a greenhouse will be enhanced by cooling the greenhouse during the day and removing excess water vapor from the air in the greenhouse. To this end, brine shower 16 is employed. Shower 16 includes header 18 which distributes brine to a plurality of webs 19 of woven material such as jute stretched between headers 18 and reservoir 20 physically located below the header. The header and reservoir are located inside enclosure 12 and are positioned in the path of air blower 22 which produces a flow of air from the enclosure across the woven webs 19 on which a film of brine is present. Brine from the webs drains into reservoir 20.

If the brine is relatively cool, its vapor pressure will be very low compared with the vapor pressure of the water vapor in enclosure 12. As a consequence, the brine will be hygroscopic and water vapor will condense on the surface of the brine film covering webs 19. The condensation of water vapor on the film of brine will release the heat of condensation of water to the brine itself thereby raising the temperature of the brine. During the day, the air temperature in the qreenhouse generally will exceed the temperature of the brine which will be heated as a consequence. The somewhat diluted and somewhat heated brine flowing into basin 20 is returned to a brine reservoir.

The system described above is conventional in nature and is well known to those skilled in the art. Brine for shower 16 is furnished by heat exchanger 10 which includes upper fluid layer 26 and lower fluid layer 28. Upper layer 26 is constituted by fresh or brackish water. Lower layer 28 is constituted by the brine used in shower 16. In this embodiment of the invention, the fluid in layers 26 and 28 are static. Thus, during daylight operation, brine from the lower portion of lower layer 28 is conducted by pipe 30 to pump 32 which supplies the brine via conduit 34 to header 18 of the brine shower. Warmed brine collected in basin 20 associated with the brine shower is returned via conduit 36 to the upper portion of lower layer 28. With the arrangement just described, the upper portion of lower layer 28 will be warmer than the lower portion of the layer.

The liquid in upper layer 26, being considerably fresher than the brine in lower layer 28 is less dense than the brine. A large and steep density gradient thus exists at interface 38 between the two layers in reservoir 10; and this gradient suppresses mechanical mixing of the two layers. Some heat in the upper portion of the lower layer is transferred across interface 38 into the lower portion of the upper layer by conduction. However, the present invention provides for enhancing the heat flux; and to this end, heat transfer means 40 are employed. Such heat transfer means, according to the present invention, are in the form of a plurality of closed sleeves, such as elongated, vertically oriented cylinders 42. The upper axial ends of the cylinders extend into the upper layer, and the lower axial ends of the cylinder extend-into the lower layer. Preferably, the cylinders are tubular sleeves that are closed at each end and filled with fluid 44, preferably, fresh water.

Water contained in the lower portion of the cylinders is heated by the transfer of heat from the brine in layer 28 across the sleeves and its density is reduced. The resultant buoyant water displaces cooler water contained in the upper portion of the sleeves, the cooler and more dense water flowing downwardly to replace the buoyant water. Heat contained in the buoyant water that rises to the upper portion of the sleeves is transferred by conduction across the sleeves into the upper layer thereby heating the water in the upper layer. In this manner, the heat of condensation produced by the condensation of water vapor in enclosure 12 in association with brine shower 16, and sensible heat removed from the air in enclosure 12 is first transferred to the brine in layer 28 and then to the water in layer 26. This process continues during daylight hours; and upper layer 26 accumulates heat during the day in enclosure 12.

At night, when the temperature in the enclosure decreases, the heat stored in upper layer 26 is made available for heating. The heat contained in upper layer 26 can be used for a variety of purposes. For example, it can be used to heat the greenhouse; and the preferable way to accomplish this is to circulate water from the upper layer through a closed heat exchanger in the greenhouse. This expedient has the advantage of heating the air in the greenhouse without increasing its humidity. The disadvantage, however, is the added cost of an indirect heat exchanger. Symbolically, heat removal from the upper layer is indicated in FIG. 1 by pump 41 that circulates water from layer 26 through radiator 43.

The brine in lower layer 28 must be reconstituted periodically to remove the water of condensation absorbed by the brine in shower 16. Many ways exist to achieve this; for example, the brine can be concentrated by spraying it as disclosed in U.S. Pat. No. 4,704,189 issued Nov. 3, 1987, the disclosure of which is hereby incorporated by reference. Concentration of the brine is shown schematically at 47 as a drier connected to the lower layer.

Cylinders 42, containing water fresher than the brine in layer 28 will be buoyant; and this may require weighting of the bottom of the sleeves so as to counterbalance their buoyancy. This is illustrated by reference numeral 45. Alternatively, or in addition, the water filled tubular sleeves may be stabilized by the use of guys attached to the walls of housing 24.

Preferably, the tubular sleeves are comprised of a thermoplastic polymer such as polyolefin, where the polyolefin is selected from the group consisting essentially of polyethylene and polypropylene. The film from which the tubular sleeves is made should have a thickness of approximately 0.1 mm in order to enhance the transfer of heat across the film. Preferably, the tubes have a length to diameter ratio (L/D) in excess of about 50. Thus, a practical arrangement would involve about 100 sleeves per square meter of cross-section of the housing, the length of the sleeves being about 1 meter.

Figure 2:
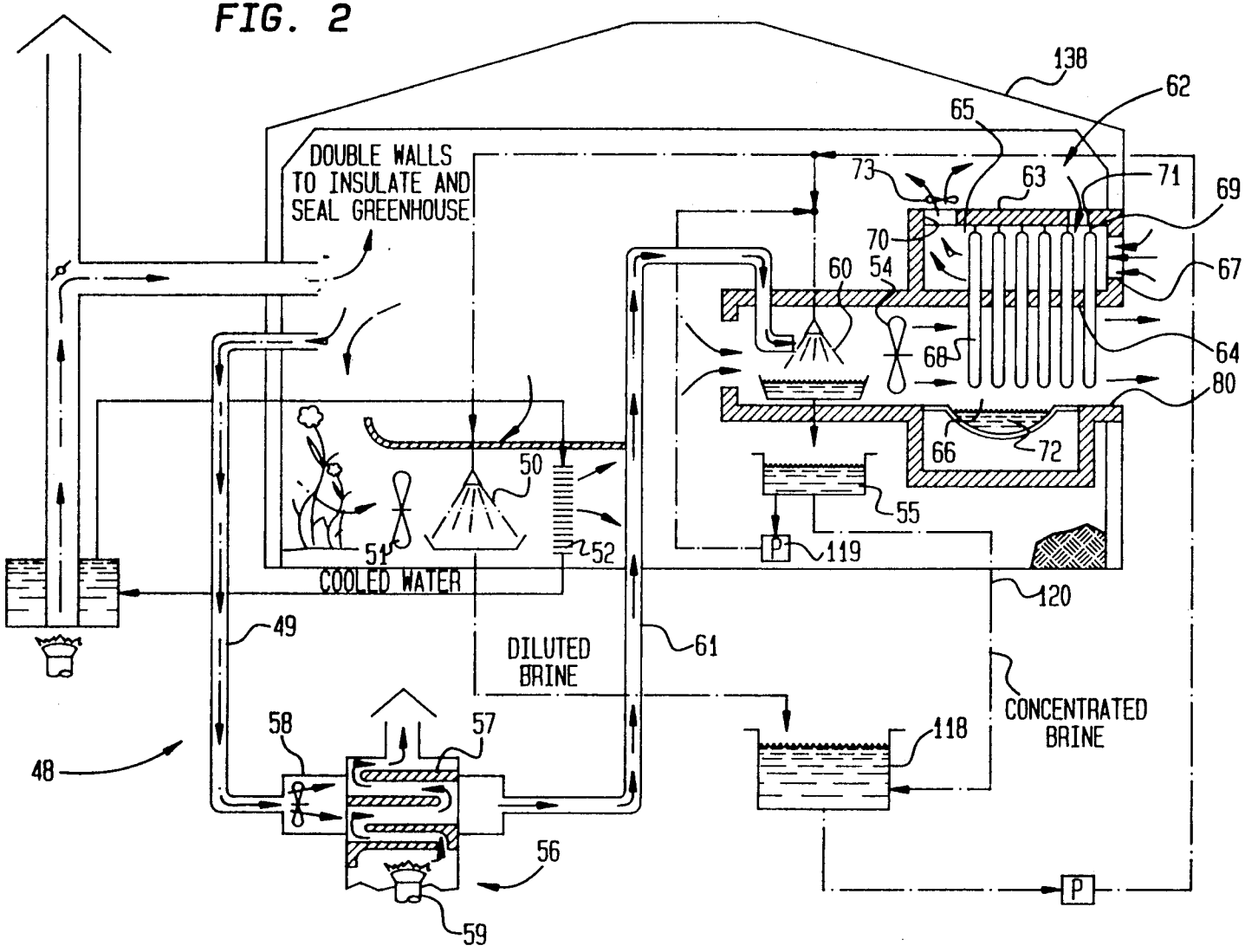
FIG. 2 is a schematic block diagram of an enclosure in the form of a greenhouse having a heat exchanger in accordance with the present invention.

In the preferred form of the invention designated by reference numeral 49 in FIG. 2, a heat exchanger similar to that disclosed in U.S. Pat. No. 4,803,846 can be used. As shown in FIG. 2, brine in reservoir 118 is pumped to first air-brine-vapor heat exchanger 50 (shown as a brine shower) through which air in well-insulated greenhouse 138 passes by reason of the operation of blower 51. After contacting the air and absorbing water vapor in the air, the brine is diluted and returns to reservoir 118. Preferably, heat exchanger 50 operates under conditions of substantially constant enthalpy. When necessary, heat is supplied to the air in the enclosure by providing closed heat exchanger 52 in the path of the air exiting heat exchanger 50, heat exchanger 52 being supplied with hot water from boiler 53 which, in the manner disclosed in the '846 patent, can also be used to regenerate the dilute brine.

The regeneration process in the present invention is carried out by contacting dilute brine collected in reservoir 118 with air exhausted from the enclosure by the operation of blower 54 and vented to the atmosphere at 80. The dilute brine is contacted with the exhausted air in second air-brine-vapor heat exchanger 60 (shown as a brine shower) after the exhausted air is heated to a temperature above that of the brine by air heater 56. In its operation, heater 56 draws air from or exhausted from the enclosure via conduit 49 into indirect heat exchanger 57 by operation of blower 58, the air being indirectly heated by flue gases produced by burning fuel at 59. The air, so heated, is ducted by conduit 61 to second heat exchanger 60 upstream thereof for contact with dilute brine in second heat exchanger 60. Alternatively, combustion or flue gases can be use to directly heat the enclosure air for contacting the dilute brine in heat exchanger 60.

The dilute brine in heat exchanger 60 gives up water to the heated exhausted air and is concentrated before being returned to reservoir 118. Preferably, reservoir 55 and pump 119 are provided for ensuring a relatively high brine flow rate (approximately 1000 liters per hour) at direct contact air-brine-vapor heat exchanger 60, with concentrated brine finally being returned to reservoir 118 via overflow conduit 120.

The air that is exhausted through vent 80 contains excess sensible heat, by reason of the addition of air heated by heater 56, and a considerable amount of latent heat in the water vapor contained in the air as a consequence of the operation of heat exchanger 60. To recover this heat, heat exchanger 62, according to the present invention, is utilized. Thus, heat exchanger 62 functions to return to the enclosure most of the heat produced by heater 56.

Heat exchanger 62 constitutes heat exchanger means responsive to moist or humid air exhausted from the enclosure for transferring heat contained therein back to the air in the enclosure. It comprises housing 63 having horizontally disposed divider 64 for dividing the housing into upper chamber 65 and lower chamber 66, the two chambers being separate by reason of divider 64. Blower 54 serves as means for directing exhausted air through lower chamber 66 before the exhausted air is vented at 80. Blower 73 serves as means for drawing both ambient air and enclosure air through upper chamber 65.

The heat exchanger also includes a plurality of closed sleeves, such as elongated, vertically oriented cylinders 68 which extend through divider 64 into each of the chambers 65, 66. These cylinders are hollow and contain convective fluid, preferably water or a mixture of water and chemicals for inhibiting bacterial growth, or freezing. The cylinders may be suspended from the roof of housing 63 as indicated schematically at 69.

In many respects, the cylinders in heat exchanger 62 are the same as those described in connection with FIG. 1. That is to say, the cylinders may be of relatively thin plastic film whose thickness may be in the range 0.1 to 0.2 mm., the thickness not being critical to the basic operation of the heat exchanger except to the extent that the cylinders when filled with liquid must be sufficiently strong to retain their shape. Finally, to prevent buffeting of the cylinders in lower chamber 66 by the flow of air produced by blower 54, the lower ends of the cylinders may be fixed or connected to the housing. Alternatively, or in addition, the lower ends of the cylinders may be weighted as shown in FIG. 1.

A heat exchanger according to the present invention was constructed and tested. It measured about 2 m. high, 1.2 m. wide, and 2 m. long. One thousand cylinders about 1.9 m. in length were used, the film thickness of the cylinders being 0.1 to 0.2 mm. providing an area for heat transfer of about 200 $m^2$.

In operation, enclosure air typically is at 17° C. and 85% humidity (i.e., about 10 g water/Kg air) when the enclosure is in the form of a greenhouse. The operation of air heater 56 is such that the temperature of the exhausted air and the air produced by the air heater is about 95° C. as the air contacts the brine in heat exchanger 60. The heated exhausted air evaporates water from the dilute brine in the heat exchanger, is cooled, and becomes moist before it exits the enclosure through vent 80. Under design conditions, the air exits heat exchanger 60 at about 40° C. and about 47% humidity (i.e., about 23 g water/Kg air). This air now enters lower chamber 66 of heat exchanger 62 where the air is cooled by its contact with cylinders 68. Moisture in the air condenses on the cylinders such that the latent heat of condensation is also transferred to the water in the cylinders. The condensate on the exterior of the cylinders drips into collection pool 72 and may be disposed of. Subsequently, the cooled air in lower chamber 66 exits at 80 at about 17° C. in a saturated state (i.e., 14 g water/Kg).

The water contained in the lower portions of the cylinders is heated by the heat exchange process described above, and becomes buoyant rising toward the tops of the cylinders which are in contact with ambient air entering the heat exchanger though intake 67, and with enclosure air entering the heat exchanger at intake 71, preferably by operation of blower 73. Typically, the ambient air is at 7° C. and 80% humidity (i.e., 5 g water/Kg air). This replacement air flows over the top portions of the cylinders and is warmed, typically, to about 19° C. before entering the enclosure through exit 70 in housing 63. If the rate at which ambient air entering the enclosure is comparable to the rate at which air normally would infiltrate a conventional greenhouse, say about 2,000 $m^3$/hr, then by operating the present invention in a well-sealed enclosure, substantially all of the heat used to concentrate the brine is returned to the enclosure. Moreover, adding even such a small amount of ambient air to the enclosure serves as a source of further dehumidification that supplements the effect of the dehumidification carried out by heat exchanger 50. By a proper selection of fan 73, and the size and location of openings 70 and 71 in the top of housing 63, the closed loop circulation of air in the enclosure through upper chamber 65 will be about 10,000 $m^3$/hr. From actual measurements, the heat transfer coefficient of heat from the warm air to the cool air was found to be about 17 watts/° C. $m^2$.

While the above description refers to the use of the present invention for conditioning the air in a greenhouse, heat exchanger 62 is specifically applicable for use as an air recuperator in other systems such as in enclosure cooling systems (e.g., those used in cold storage enclosures and in enclosures where mushrooms are grown, etc.) where the enclosure is ventilated with external or ambient air. Use of such a cooling system will permit air exiting the enclosure to cool the ambient air entering the enclosure.

The advantages and improved results furnished by the method and apparatus of the present invention are apparent from the foregoing description of the preferred embodiments of the invention. Various changes and modifications may be made without departing from the spirit and scope of the invention as described in the appended claims.

I claim:

1. A heat exchanger for exchanging heat between a warmer fluid and a cooler fluid, said heat exchanger comprising:

a) a housing having a divider for dividing the housing into separate chambers, one of which is adapted to contain said warmer fluid, and the other of which is adapted to contain said cooler fluid;

b) a plurality of elongated cylindrical sleeves of relatively thin plastic film mounted in said housing such that the cylindrical sleeves extend through said divider and project into the two chambers and are in heat exchange relationship with the warmer and cooler fluids; and d) convective fluid in the cylinders.

2. A heat exchanger according to claim 1 wherein said convective fluid is a liquid.

3. A heat exchanger according to claim 2 wherein the fluid in each of said upper and lower chambers is a gas.

4. A heat exchanger according to claim 2 wherein said divider is horizontal and said cylindrical sleeves are oriented in a vertical direction.

5. A heat exchanger according to claim 4 wherein the chamber containing the warmer fluid is located above the chamber containing the cooler fluid.

6. A heat exchanger according to claim 5, wherein the fluid in each of said chambers is a gas.

7. A heat exchanger according to claim 1 wherein the thickness of the film is in the range 0.1 to 0.2 mm.

8. A heat exchanger according to claim 1 wherein said convective fluid includes water.

9. A heat exchanger according to claim 8 including means for causing the gas in each of said upper and lower chambers to flow in opposite directions.

10. A heat exchanger according to claim 1 wherein the fluid in each chamber is static.

11. A heat exchanger according to claim 10 wherein the fluid in each chamber is a liquid.

12. A heat exchanger according to claim 1 wherein the fluid in each chamber flows relative to the cylinders.

13. A heat exchanger according to claim 12 wherein the fluid in each chamber is a gas.

14. A heat exchanger according to claim 12 wherein the fluid in at least one of the chambers is a liquid.

15. A heat exchanger according to claim 12 wherein the fluid in at least one of the chambers is a gas.

* * * * *